United States Patent [19]

Johnson et al.

[11] 4,358,667

[45] Nov. 9, 1982

[54] CARTRIDGE-TYPE ELECTRIC IMMERSION HEATING ELEMENT HAVING AN INTEGRALLY CONTAINED THERMOSTAT

[75] Inventors: Ronald S. Johnson, Limington; Stephen E. Hasty, Kezar Falls, both of Me.

[73] Assignee: International Telephone and Telegraph Corporation, New York, N.Y.

[21] Appl. No.: 138,773

[22] Filed: Apr. 10, 1980

Related U.S. Application Data

[63] Continuation of Ser. No. 861,382, Dec. 16, 1977, abandoned.

[51] Int. Cl.[3] ..... H05B 1/02; H05B 3/82; H01H 37/04; H01C 1/03

[52] U.S. Cl. ..... 219/331; 219/316; 219/330; 219/335; 219/337; 219/508; 219/512; 219/523; 337/380; 337/381; 338/240; 338/241

[58] Field of Search ..... 219/328, 331, 330, 335–337, 219/316, 318, 523, 508, 510, 512; 337/380, 381; 338/240, 241

[56] References Cited

U.S. PATENT DOCUMENTS

| | | | |
|---|---|---|---|
| 2,727,116 | 12/1955 | Alfred et al. | 337/380 UX |
| 2,754,407 | 7/1956 | Smith | 219/523 |
| 2,784,292 | 3/1957 | Haloski | 219/523 X |
| 2,789,201 | 4/1957 | Sherwin | 219/318 X |
| 2,816,207 | 12/1957 | Boggs | 219/328 X |
| 2,866,041 | 12/1958 | Dell | 337/381 X |
| 3,277,277 | 10/1966 | Wells | 219/328 X |
| 3,371,192 | 2/1968 | Rosenel | 219/523 |
| 3,399,295 | 8/1968 | Chaustowich | 219/328 X |
| 3,440,109 | 4/1969 | Plattner | 219/523 X |
| 3,767,898 | 10/1973 | Wells et al. | 219/523 X |
| 4,068,116 | 1/1978 | McKinstry | 219/331 X |

FOREIGN PATENT DOCUMENTS

| | | | |
|---|---|---|---|
| 2623794 | 12/1977 | Fed. Rep. of Germany | 219/523 |

*Primary Examiner*—A. Bartis

*Attorney, Agent, or Firm*—John T. O'Halloran; David M. Quinlan

[57] ABSTRACT

A cartridge-type electric immersion heating element having an integrally contained, self-limiting thermostatic control included in its electrical circuit includes an electric resistance heating element embedded in compacted powdered insulating material partially filling a tubular metallic sheath open at one end. A preset thermostat is located within a thermostat sleeve positioned in close proximity with the sheath wall and has an end embedded in the insulating material. The thermostat is connected in series circuit with the heating element and the ends of power supply leads enter the sheath through the open end thereof. A body of potting compound, such as epoxy resin, completely fills the remainder of the sheath, seals the open end thereof and encapsulates the other end of the sleeve and the power supply lead ends whereby the sleeve and thermostat are securely held in position in the sheath.

7 Claims, 7 Drawing Figures

CARTRIDGE-TYPE ELECTRIC IMMERSION HEATING ELEMENT HAVING AN INTEGRALLY CONTAINED THERMOSTAT

This is a continuation of application Ser. No. 861,382, filed Dec. 16, 1977 now abandoned.

BACKGROUND OF THE INVENTION

1. Field of the Invention

Cartridge-type heating elements.

2. Prior Art

The utilization of thermostatic elements to control heat is, of course, well known and widely practiced in virtually every area where temperature control is necessary or desirable. In most instances, the thermostatic control of the electrical circuit for the heating element is located at a point which is remote from the heating element itself and serves to interrupt the flow of electrical heating current to the heating element.

In the cartridge heater field where such heating elements are used in immersion applications or for the conduction heating of solids where either control or overheating protection of the system is required, various attempts have been made to provide for simple and inexpensive thermostatically controlled heating elements.

One example, which has been utilized in the past, is the thermal fuse type in which one branch of the circuit to the heating element includes a solder type of joint which has a predetermined melting point. If the temperature at the solder point exceeds the predetermined limit, the solder melts opening the circuit and thus permanently disabling the heater.

In another successful product, an adjustable thermostat has been positioned internally near the top of a cartridge-type heater. In practice, the thermostat is designed to have adjustable set points by means of a shaft extending out of the cartridge heater which, in turn, rotates to mechanically vary the position of bimetallic contacts and thus alter the temperature at which the circuit to the heating element is interrupted. Such adjustable thermostatically controlled cartridge heaters are very expensive and difficult to manufacture. In order to achieve the necessary precision of control, extensive hand labor, involving many individual steps, are involved. Of necessity, the material costs are excessive for widespread applications. Thus, the adjustable thermostat itself, along with the hermetic seals and related structure permitting the thermostat to be adjusted externally are all expensive elements. In order to assemble the adjustable thermostatically controlled cartridge heater element, the adjustable thermostat and its control shaft along with the electrical leads must be first assembled and then inserted into the sheath in such a manner as to not disturb the previously aligned insulation discs and heater elements and leads which must be first positioned in the lower portion of the sheath.

A still further example of the prior art thermostatically controlled cartridge-type heaters utilized a snap disc thermostat placed in the bottom of a tube or sheath of a cartridge-type heater. Such thermostats are expensive and are of necessity relatively large in diameter. In addition, by nature, their operation depends on a large surface area of contact which means that one face of the thermostat must be in contact with the bottom end of the cartridge-type heater. Due to size limitations, such snap disc thermostat elements could only be positioned in heaters of the cartridge-type which are at least three-quarters of an inch in diameter or larger. The leads to the thermostat are attached to one of the heater coils fitted into a ceramic core element. Of necessity, the specific type of cartridge heater which could utilize a snap disc thermostat is of the low watt density type since the higher watt density types, which require packing the sheath with a compressed quantity of magnesium oxide, was not possible without interfering with the preset temperature at which the snap disc thermostat would open the circuit to the heating coils.

SUMMARY OF THE INVENTION

In the self-limiting heater of this application, a combination heater/thermostat assembly is provided by positioning a preset high limit temperature switch or control within the sheath of either a low watt density cartridge-type heater or a high watt density type of heater. The thermostat selected is one which is preset to open the circuit to the heater coils at a temperature which is less than that which could be harmful to the heating coils, the equipment in which it is installed or the material being heated.

The resultant structure is completely self-contained and is, therefore, ideal where space is a premium. Since the thermostat is located internally of the sheath which also contains the heating element, it is located adjacent to the heating coils and, therefore, has direct control over the heating elements in any operating condition. It provides excellent overheating response especially in situations where liquids are being heated and thus avoids the situation where there is a run dry condition. Since the thermostat is located in the same structure and is immediately adjacent the heating elements, the combination of elements reduces and, in many cases, eliminates unnecessary burn-outs. The system is extremely simple and permits the design of simplified heating applications by eliminating, in many instances, the need for separate thermostat elements along with their mounting and hook-up into the circuit.

The heater in accordance with the present invention is self-contained within a metallic sheath having a lower portion defining a hot zone and an upper portion. A preset self-limiting thermostat is connected in series circuit to the heater elements and located in the upper portion closely adjacent the metallic sheath. The thermostat is so positioned to be responsive to the existing temperature condition of the sheath in order to open the circuit at the preset temperature thereby preventing damage to the heater.

The combined structure of this invention is designed for use where cartridge-type heaters may be used for either conduction heating of solids or for immersion applications where control or overheating protection of the system is necessary or desirable.

DESCRIPTION OF THE PREFERRED EMBODIMENT

Figure 1:
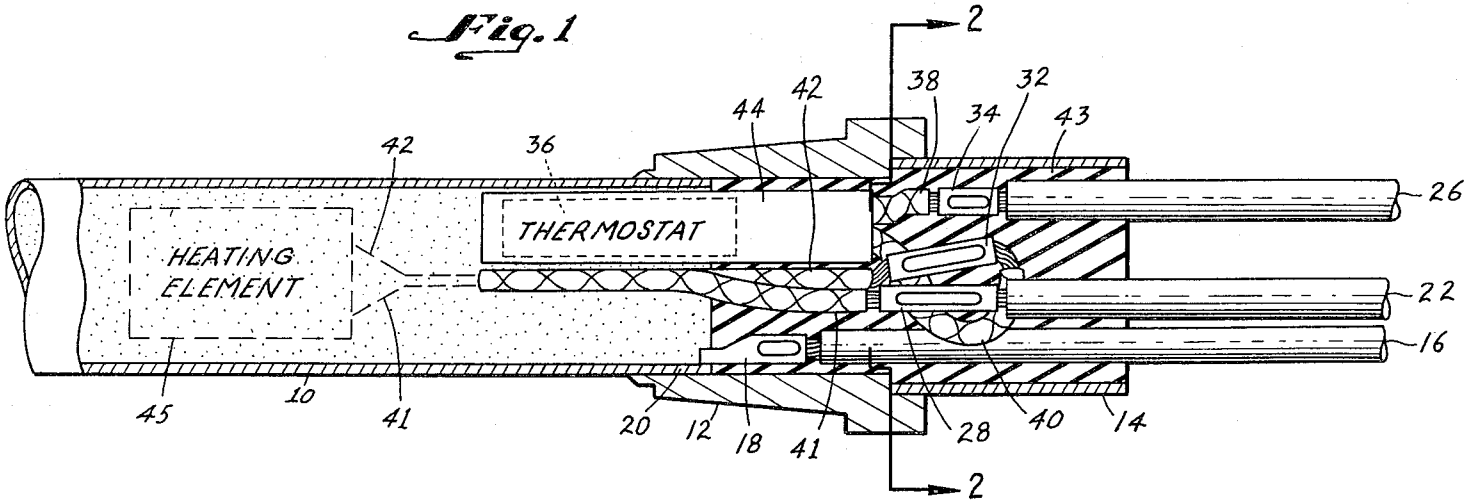
FIG. 1 is a partial cross-sectional view of a cartridge heater illustrating the principles of this invention.
Figure 2:
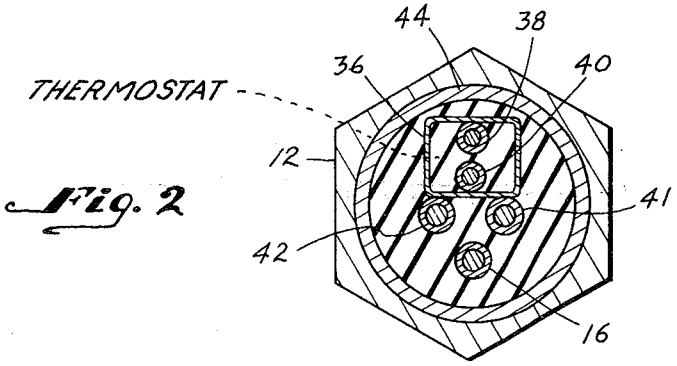
FIG. 2 is a section view taken along section line 2—2 of FIG. 1.

Referring to the device illustrated in FIGS. 1 and 2, it will be seen that a sheath 10 is provided to which is attached a bushing 12 as, for example, by welding. A potting sleeve 14 is positioned into a counterbore of the bushing 12. A ground lead 16 has attached to it a ground lead connector 18 which is, in turn, welded at 20 to the top lip of the sheath 10. Power leads 22, 26 are illustrated which connect to the heating coil positioned in the lower portion of the sheath 10 in the device illustrated in FIG. 1. A connector 28 attaches the lead 22 to lead 41 connected to one end of the heating coil elements (45). Terminals 34 connects lead 26 to a preset thermostat 36 which will be described in detail below. One of the leads 38 leading to the thermostat 36 is attached by means of connector 34 to lead 26, while the other of the leads 40 to the thermostat 36 is attached by means of connector 32 to heating coil lead 42 leading to the other end of the heating coil elements. Since the thermostat 36 is of the live metal case type, an insulating sleeve 44 surrounds it to avoid its coming into electrical contact with the metallic sheath 10.

In the assembly of the device illustrated in FIG. 1, the heating elements 45 comprise ceramic cores in which are located the heating coils themselves which may be of the standard nickel-chromium type located in the lower portion of the sheath 10 as illustrated in FIG. 1. These elements are first positioned with their leads 41, 42 extending upwardly. If desirable, magnesium oxide is compacted to fill the space between the cores and the interior of the sheath 10. Plugs are used in compacting the magnesium oxide in order to leave a substantial cavity at the top end of the heater as illustrated in FIG. 1. The connectors 28, 32, 34 are utilized to join leads 22 and 26 to leads 42, 41 connected to the heating coils (not shown) and to the lead wires 38 and 40 for the thermostatic element 36. The ground lead connector is welded in place at the top lip of sheath 10. The bushing 12 is welded to the sheath 10 prior to inserting thermostat 36 into the cavity in order to avoid heat damage to the thermostat 36. The thermostat 36 positioned in its sleeve 44 is inserted so that the sleeve 44 is in contact with the sheath 10 as illustrated. Next, the potting sleeve 14 is positioned and the cavity at the top is filled with an insulating material 43 such as epoxy. The respective position of the elements would, therefore, be maintained by the epoxy filling material 43 in a position as illustrated in FIG. 2 which shows the position of the thermostat 36, its insulating sleeve 44, its lead wires 38, 40 and the heater leads 41, 42 positioned relative to the bushing 12. As illustrated the thermostat 36 is positioned at a critical location so that it is closely adjacent the sheath 10 and will be sufficiently removed from the heating coils so as to act as a critical protection to avoid overheating of the heating coils, the sheath 10 or the material which is being heated by the device illustrated in FIGS. 1 and 2.

Figure 3:
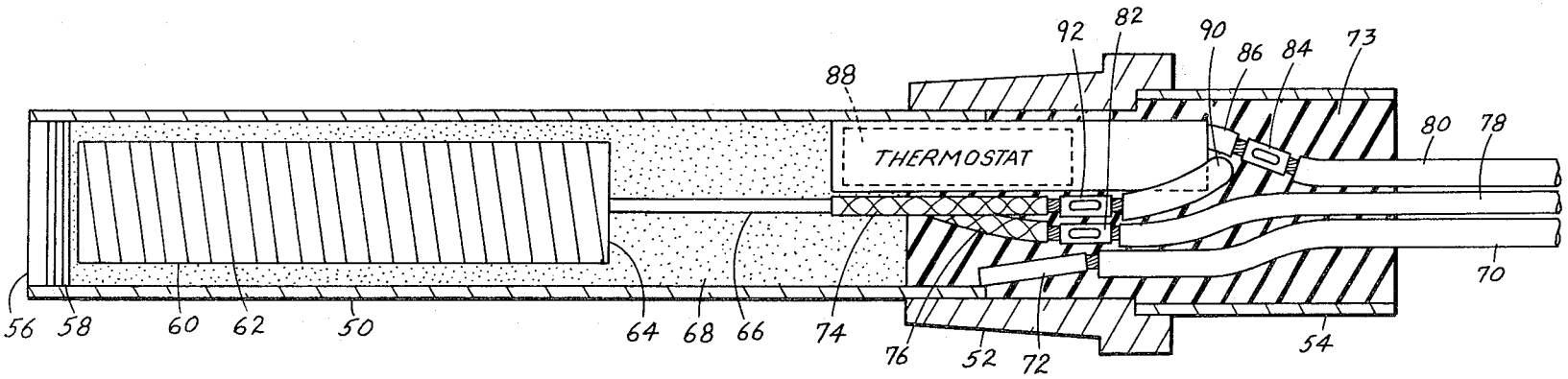
FIG. 3 is a cross-sectional view of a high watt density type of cartridge heater utilizing the structure of this invention.

In the form of the device illustrated in FIG. 3, a cartridge heater of the high watt density type is illustrated. In the device illustrated in FIG. 3, a sheath 50 is provided which has a bushing 52 attached thereto and a potting sleeve 54 mounted in a counterbore of the bushing 52. An end disc 56 closes the bottom end of the device by welding. A plurality of mica discs 58 are positioned adjacent the end disc 56. The heater core 60 consists of high watt density resistance heating wires 62 wound on a ceramic core 64 with the resistance wire 62's ends being attached (not shown) to cold pins 66. Compacted magnesium oxide fill 68 fills up the interior of the lower portion of the device illustrated in FIG. 3. A ground lead 70 is connected by connector 72 which, in turn, is welded to the lip of sheath 50. Each of the cold pins 66 is connected by a lead wire 74, 76 to the power leads 78, 80, one connector 82 being utilized to connect leads 78 directly to lead 76 connected to one of the cold pins 66 forming of the electrical circuit to resistance wires 62. The other lead 80 is connected by connector 84 to one of the thermostat leads 86 leading to thermostat 88. The other lead 90 from thermostat 88 is connected by connector 92 to the other of the leads 74 leading to the other of the cold pins 66, thus completing the circuit through the thermostat 88.

As before, the assembly of the device is substantially as described in connection with the devices illustrated in FIGS. 1 and 2 and again the potting sleeve is used to position epoxy material 73 in the open cavity at the top of sheath 50. Also, since the thermostat 88 is of the live metal case type, an insulating sleeve 94 is utilized to avoid metal-to-metal contact between the case of the thermostat 88 and the sheath 50.

It will be noted that in the device illustrated in FIG. 3, there is a heated area of the sheath 50 which corresponds approximately to the length of the heater core 60. It is also to be noted that the thermostat 88 is positioned adjacent to the heated core and within the same sheath 50, but is removed so that it can not only sense the temperature of the structure but it also can sense the temperature of the surrounding material which is being heated by the device illustrated in FIG. 3.

Figure 4:
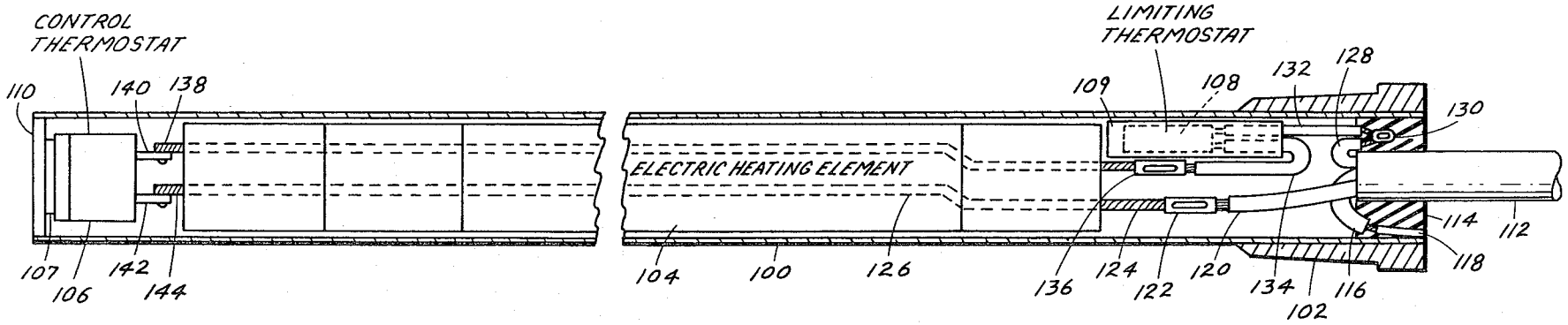
FIG. 4 is a partial cross-sectional view of a further embodiment of a cartridge heater embodying the subject matter of this invention.

For a number of uses, the device illustrated in FIG. 4 has particular application. A sheath 100 having a bushing 102 contains a ceramic core 104 having openings therethrough in which are positioned the heating coils 126. In the device illustrated in FIG. 4, there are two thermostats 106, 108. The thermostat 106 is of the type used as described above in the Prior Art section which is a snap disc type of thermostat positioned so that its end face 107 rests squarely against the bottom or end disc 110 which can thus act as the control thermostat while the thermostat 108 is positioned in contact with the upper portion of the bore of the sheath 100 and thus acts as a limiting thermostat. A standard three-wire cord set 112 is positioned in epoxy potting compound 114 at the top of the device illustrated in FIG. 4. The ground lead 116 is attached to a connector 118 and is welded to the top lip of sheath 100. One of the power leads 120 is connected by means of connector 122 to lead 124 which is directly connected to the heater coils 126. The other power lead 128 is connected by means of connector 130 to one lead wire 132 leading to thermostat 108. The other lead 134 of thermostat 108 is connected by means of connector 136 to lead wire 138 connected to terminal 140 of thermostat 106. The other terminal 142 of thermostat 106 is connected to lead 144, completing the circuit through heater coils 126. As before, high limit thermostat 108 is covered by an insulating sleeve 109 and is positioned so as to locate the thermostat 108 adjacent to the sheath 100.

Representative dimensions for the device illustrated in FIG. 4 show a bottom cold portion of approximately three inches between the control thermostat 106 and the hot section of approximately 9¼" or 9" where the heater coils 126 are located. Above the hot area is another dimension of approximately three inches, again up to the bottom of the bushing 102. This provides for some isolation between the hot portion of the cartride heater device illustrated in FIG. 4 and the two thermostats, the control thermostat 106 and the high limit thermostat 108.

Figure 5:
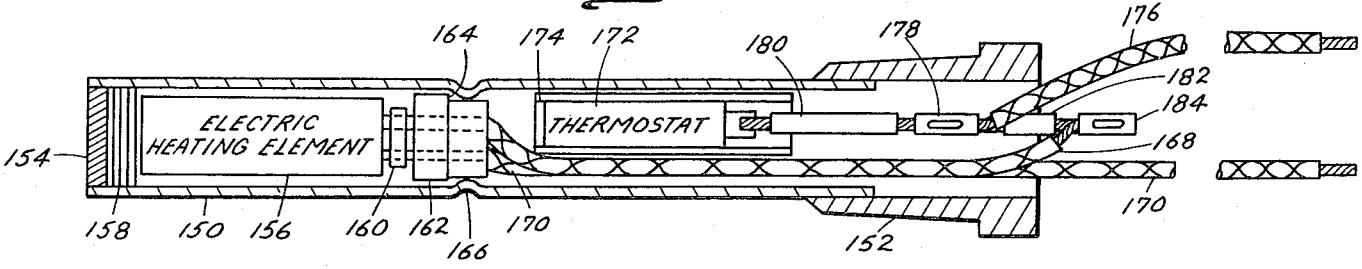
FIG. 5 is a cross-sectional view illustrating a further embodiment of the structure of this invention.

A particularly compact arrangement employing the principles of this invention is illustrated in FIG. 5 wherein a sheath 150 is provided having a bushing 152 and sealed by end disc 154. A heater core 156 is located in the bottom portion of the device with a plurality of mica discs 158 positioned between the bottom of the core 156 and the end disc 154. Strain relief disc 160 is positioned between the cap element 162 and the core 156. A shoulder 164 on the cap 162 permits a crimped area 166 of the sheath 150 to retain the cup 162 and core 156 in place. As was previously described, the space between the core 156 and the sheath 150 may be filled with magnesium oxide. Leads 168, 170 connect the core 156 to the electrical power supply. Lead 170 goes directly to the core 156 whereas lead 168 is connected in the circuit which includes the thermostat 172 positioned as illustrated. The thermostat 172 is covered by a sleeve 174 of an electrical insulating material. A lead 176 connects the power supply to the thermostat 172 through connector 178, thermostat lead 180 and the return circuit is via lead 182 to connector 184 to which is also connected the other lead 168 leading to the core 156.

Figure 7:
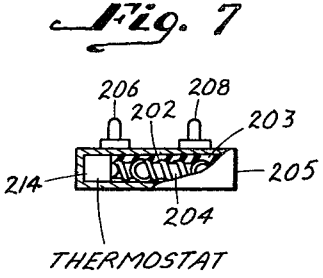
FIG. 7 is an end view of the portion of the device illustrated in FIG. 6 broken out to show the location of the present thermostatic element in relation to the heater coils of the device illustrated in FIGS. 6.
Figure 6:
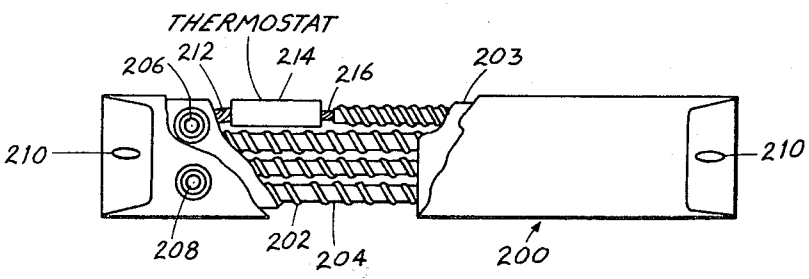
FIG. 6 is a partial cross-sectional plan view of a heater of the strip type utilizing the teachings of this invention.

In the version of the device illustrated schematically in FIGS. 6 and 7, a strip heater 200 is provided which is of a substantially rectangular form in which heating coils 202 are positioned inside a ceramic core 203 having openings arranged in parallel. The heating coils 202 may be positioned around a ceramic rod element 204. The ceramic core 203 is enclosed in an elongated substantially rectangular metallic sheath 205. Power connections to the strip heater 200 are by terminals 206, 208. Openings 210 may be provided for attaching the strip heater 200 to any flat surface. The terminal 208 is connected directly to the heater coils, whereas terminal 206 is connected by means of a lead wire 212 to one side of a thermostat 214 and lead 216 connects the other side of the thermostat 214 to the heater coils 202, thus completing the circuit between the power supply via terminals 206, 208 the coils 202. In FIG. 7, the respective position of the thermostat 214 in relation to terminals 206, 208 is shown along with the position of the heater wires 202 ontheir core element 204.

In each of the above-described embodiments, a different type of thermostat than has previously been employed in this type of heater is utilized. A relatively small physically sized and inexpensive preset thermostat is employed. This permits, for the first time, heaters of the cartridge type as illustrated in the embodiments described above to have preset thermostatic controls and still remain price competitive. The efforts described in the Prior Art section either resulted in larger and more expensive devices or could only be used in those applications where the expensive types and sizes were warranted. Additionally, the location of the thermostat of the snap action disc type was constrained to the bottom of the sheath whereas, with the device illustrated in FIGS. 1 through 7, the thermostat can be positioned so as to be responsive to the temperature of the heating coils themselves and, by virtue of its intimate contact with the sheath, is very sensitive to its environment and particularly environment of the material being heated.

Of particular usefulness are thermostats of the type manufactured by Portage Electric Company, Canton, Ohio, Models B or C and equivalents. It is necessary that the thermostat to be useful in the combination of this invention be physically small and inexpensive. In most instances, as has been pointed out above, such thermostats have live (uninsulated) metallic cases and must be required to withstand high amperage. The live metal cases can be insulated by the sleeve illustrated and described in connection with the embodiments above.

Accordingly, the devices of this invention provide for a simple construction which comprises an outer sheath, a heater element of the low watt density or the high watt density cartridge type including an inexpensive physically small thermostat which is preset and is inserted in series with one of the supply leads. The smaller length and inexpensive cost of providing the controls in this type of heaters permits the entire heater to be considerably smaller, both in diameter and length, as contrasted with the prior art described above which had to be much larger in diameter and length and required a considerably higher cost. The units of this invention now make it possible to extend the controls to much smaller size and capacity heating elements.

It will be appreciated that the thermostat elements used in accordance with the teachings of this invention can typically have a preset temperature range, when they are of bimetal construction, of from between 95° F. and 400° F. Typically, such thermostats are provided with a tolerance of ±8° Minimum at the temperature which they will open as that compared with the preset temperature.

The length of the assemblies of the devices illustrated in the figures can vary depending upon the type of the thermostat used, the wattage of the heater and the specific application in which the devices of this invention are to be used. Typically, there are three primary types of applications which affect the assembly length. When a device of this invention is designed to detect a run dry condition to prevent heater burn-out, a high limit thermostat is located close to the internal heater coil. This allows the thermostat to detect and to react to the coils' overheating condition quickly before it melts and is disabled. The total cold length of this type of cartridge will require from 1¼" to 1½" dimension to accommodate the thermostat and the internal connection area. In addition, of course, there is the length of the cartridge which is adjacent the heater coil. An assembly designed in accordance with the principles of this invention utilized to detect a run dry condition can be quite short, providing the wattage of the heater itself is low.

In an application where a device of this invention is utilized to guard against overheating of a solution or overheating of a solid in which the heater is inserted, the internal high limit thermostat is moved farther away from the heater's coil than a device designed to detect a run dry condition. This is to allow the thermostat to sense primarily the sheath or environmental temperature, while, at the same time, sensing a portion of the heater's internal temperature. Such an assembly allows anticipation of a potential overshoot condition on the heater's coil. In this instance, there will be substantially larger cold length between the heated portion of the device and the area of the location of the thermostat.

A third type of application for the device of this invention is where the temperature of a solution or a solid is controlled or is to be controlled. This type of application will require the longest assembly length. Where a control thermostat is required, it must be positioned farther away from the heater coil than in the previously described applications. In this instant, the thermostat is intended to be completely isolated from the heater coil to prevent it from sensing the coil's temperature and thus prematurely tripping the thermostat.

In this instance, the cold length of the assembly between the heated section and the location of the thermostat should be sufficiently far so that only the sheath's temperature which is in contact with the medium whose temperature is being controlled is sensed.

In some critical applications, as the device illustrated in FIG. 4 shows, it may be desirable to provide both a control thermostat for controlling the temperature of the medium being heated as well as a high limit thermostat to prevent overheating and destruction of the assembly.

It will be appreciated that the basic concepts included herein may be applied to tubular heaters of various shapes where there is sufficient space in the end of the tube to accommodate the physical size of the preset high limit thermostat as previously described.

It will be appreciated that the devices illustrated herein and described are for the purposes of disclosing the structural and functional relationship of the elements and that departures therefrom may be made which will be within the scope of the appended claims.

What is claimed is:

1. An electrical heater having an integrally contained, self-limiting thermostatic control included in its electrical circuit, comprising:

a tubular sheath means having an open end, wherein said sheath means is partially filled with compacted powdered insulating material to form a cavity at said open end;

electrical heating means embedded in said insulating material;

a preset-temperature thermostat means for opening the circuit therethrough at a preset temperature;

power supply leads for connecting said electrical heater to a power source, wherein said leads terminate at one end thereof in said cavity;

wiring means inside said sheath means for connecting said power supply lead ends, said electrical heating means, and said thermostat means in series for causing said heating means to de-energize when said thermostat means reaches said preset temperature, wherein a portion of said wiring means is in said cavity;

a thermostat sleeve having said thermostat means therein and an end embedded in said insulating material and holding said thermostat means in close proximity with said sheath means, wherein said sleeve is inside, and in close proximity with, said sheath means and a portion of saod sleeve occupies, and the other end of said sleeve terminates in, said cavity;

a body of potting compound completely filling the remainder of said cavity, sealing said open end of said sheath means and encapsulating said other end and said portion of said sleeve and said portion of said wiring means and said power supply lead ends in said cavity, wherein said body of potting compound and said compacted powdered insulating material cooperate to hold securely said thermostat sleeve in position.

2. The heater of claim 1 wherein said compacted powdered insulating material comprises magnesium oxide.

3. The heater of claim 1 wherein said sheath means is metallic and comprises a cylindrical shaped member and said open end terminates in a bushing forming an extension to said cavity.

4. The heater recited in claim 3 wherein said bushing includes a potting sleeve forming a further extension to said cavity.

5. The heater recited in claim 3 wherein said preset-temperature thermostat means is of the live-metal-case type and said thermostat sleeve comprises electrically insulating material.

6. The heater recited in claim 1 wherein said preset temperature is within a range 95° and 400° F.

7. The heater recited in claim 4 or 6 wherein said preset temperature is chosen to prevent said sheath means from attaining the temperature at which said sheath means is damaged.

* * * * *